United States Patent [19]

Kuznetsov

[11] Patent Number: 4,579,167

[45] Date of Patent: Apr. 1, 1986

[54] GRADED PITCH ELECTROMAGNETIC PUMP FOR THIN STRIP METAL CASTING SYSTEMS

[75] Inventor: Stephen B. Kuznetsov, Pittsburgh, Pa.

[73] Assignee: Westinghouse Electric Corp., Pittsburgh, Pa.

[21] Appl. No.: 561,425

[22] Filed: Dec. 14, 1983

[51] Int. Cl.[4] ..... B22D 11/06

[52] U.S. Cl. ..... 164/463; 164/429; 164/466; 164/484; 164/502

[58] Field of Search ..... 164/146, 147.1, 423, 164/427, 429, 463, 466, 467–468, 479, 502, 503–504, 468, 484

[56] References Cited

U.S. PATENT DOCUMENTS

| | | | |
|---|---|---|---|
| 2,083,022 | 6/1937 | Hoke | 164/35 |
| 3,624,572 | 11/1971 | Mallinson et al. | 335/209 |
| 3,754,634 | 8/1973 | Gerbig et al. | 164/337 |
| 3,933,193 | 1/1976 | Baker et al. | 164/146 |
| 3,980,284 | 9/1976 | Shigihara et al. | 164/147.1 |
| 4,057,096 | 11/1977 | Askin | 164/466 |
| 4,324,266 | 4/1982 | Garnier et al. | 164/147.1 |

FOREIGN PATENT DOCUMENTS

| | | | |
|---|---|---|---|
| 52-23602 | 6/1977 | Japan . | |
| 57-32856 | 2/1982 | Japan | 164/467 |

*Primary Examiner*—Nicholas P. Godici
*Assistant Examiner*—Richard K. Seidel
*Attorney, Agent, or Firm*—R. P. Lenart

[57] ABSTRACT

A metal strip casing system is provided with an electromagnetic pump which includes a pair of primary blocks having a graded pole pitch, polyphase ac winding and being arranged on opposite sides of a movable heat sink. A nozzle is provided for depositing liquid metal on the heat sink such that the resulting metal strip and heat sink combination is subjected to a longitudinal electromagnetic field which increases in wavelength in the direction of travel of the heat sink, thereby subjecting the metal and heat sink to a longitudinal force having a magnitude which increases in the direction of travel.

18 Claims, 4 Drawing Figures

GRADED PITCH ELECTROMAGNETIC PUMP FOR THIN STRIP METAL CASTING SYSTEMS

STATEMENT OF GOVERNMENT INTEREST

The United States Government has rights in this invention pursuant to Contract No. DE-AC07-831D12443 between the Department of Energy and Westinghouse Electric Corporation.

BACKGROUND OF THE INVENTION

This invention relates to thin strip metal casting systems and more particularly to such systems which include an electromagnetic pump which subjects the liquid metal and an associated heat sink to a longitudinal electromagnetic field.

Over the past decade, a significant energy reduction in the steel making process has arisen from the use of continuous slab casting technology, where steel is cast directly from the melt. An improvement in rapid solidification has arisen for the production of thin strip known as melt spinning. Here, specimens are cast directly from the melt into strips having a thickness of about 0.254 to 1.27 mm (0.01 to 0.05 inches), using a conveyor or drum assembly chilled to below the solidification temperature, at belt or wheel peripheral speeds of about 23 meters/second. Rapid solidification, where heat is extracted from the strip by a cold, high conductivity wheel, is the preferred method of processing ferrous metals. The rate at which that strip is produced is determined by the rate of heat extraction. Even where the heat transfer is high, the liquid does not acquire the full conveyor velocity before it freezes, at which instance the specimen velocity is equal to that of the conveyor. The solidification region on the conveyor varies according to the conveyor linear speed for a given ribbon thickness. At the 23 meters/second speed, strip thicknesses of about 0.635 mm (25 mils) are practical at solidification lengths of 50 centimeters and wheel temperatures of 350° K.

An electromagnetic pump of the polyphase, ac induction type, which may be used in a thin strip metal casting system, has, in a preferred arrangement, two primary members located above and below the main conveyor belt and metal ribbon specimen. Both the metal specimen, assumed to be non-ferromagnetic since the temperature is above the Curie temperature, and the metal chill block or belt form the secondary circuit for the induction of slip frequency currents. The synchronous field speed, $v_s$, of the traveling wave set up by the two primary members is determined according to the relation:

$$V_s = 2\tau_p f \tag{1}$$

where $\tau_p$ is the pole pitch of the primary in meters and f is the excitation frequency in hertz. If the surface speed of the chill block, wheel or conveyor is $V_r$, then the per unit slip is defined as:

$$S = (V_s - V_r)/V_s \tag{2}$$

for which it is understood that the frequency, $f_r$, of the currents induced in the metal strip secondary and conveyor will always be less than or equal to the frequency of the excitation according to:

$$f_r = sf \tag{3}$$

In the case when the belt speed equals the primary field speed, slip equals zero and no currents are induced in the strip or belt transport. As the belt speed is reduced slightly from synchronous speed, current density builds up linearly with slip and power dissipation builds up as the square of the change in slip over the small slip range. Irrespective of the material resistivity, the basic efficiency, $\eta$, of the system is then equal to:

$$\eta = 1 - s \tag{4}$$

where if the total power, $p_t$, is transmitted across the two air gaps into the secondary, then the quantity $\eta p_t$, is transformed into mechanical power and the quantity $sp_t$ is converted into a Joule loss for supplying the combined resistive loss of the chill block, $p_b$, and strip specimen, $p_{fe}$, as follows:

$$sp_t = p_b + p_{fe} \tag{5}$$

Since it is desired to maintain the temperature of the chill block well below the solidification temperature, it is preferable that $p_b$ is less than $p_{fe}$. To determine the individual power dissipations, it is assumed that due to the double primary layout, the magnetic flux density in either the strip specimen or the conveyor belt is equal in strength, and that the fluxes contained per square centimeter of surface are equal, thereby generating a voltage $\xi$ around a closed loop of for example 4 centimeters in periphery, l. The power dissipation in this loop is then:

$$p_{fe} = \xi^2 A / l\tau_{fe}(t) \tag{6}$$

where $\rho_{fe}$ is the volume resistivity which is a function of temperature t and cross-sectional area A of the loop which is the product of strip thickness, $t_{fe}$, and the loop transverse dimension. Therefore, the ratio of power dissipation in the strip to that in the conveyor is:

$$p_{fe}/p_b = t_{fe}\rho_b(t)/\rho_{fe}(t)t_b \tag{7}$$

where $t_b$ is the conveyor belt thickness and $\rho_b(t)$ is the corresponding volume resistivity as a function of temperature. In practical applications, $t_b$ is usually larger than $t_{fe}$, with 1.27 mm (50 mils) being a minimum level, this reduces to:

$$p_{fe}/p_b \geqq \rho_b(t)/\rho_{fe}(t) \tag{8}$$

and the temperature dependence of $\rho_{fe}$ is less pronounced than that of $\rho_b$. At a belt speed $V_r$ or 22.8 meters/second, $\rho_b$ may change by 66% over a 50 centimeter length whereas $\rho_{fe}$ will remain nearly constant at 120 micro-ohm-centimeters in the range of 1200° C. to 1421° C. (the initial solidification temperature). Specifically, the temperature coefficients of a 2.0 mm (80 mils) thick conveyor, if composed of beryllium-copper, is 0.00393/unit/°C. for temperatures above 20° C. For example, at a 77° C. initial conveyor temperature, this conductivity is $3.84 \times 10^7$/ohm-meter while at a distance of 50 centimeters along the belt, the copper surface temperature is between 900° and 1100° K., indicating a conductivity of $1.3 \times 10^7$/ohm-meter or a reduction to 34% of the initial value.

With the resistivities and thicknesses established, the specific force on each must be considered in terms of either Newtons/square meter of surface/watt dissipated in each material or else the maximum Newtons/square meter of surface for a given temperature rise in the belt. In general, the electromagnetic system will either be primary limited in Joule heating or secondary limited in Joule heating, consequently lengthening the solidification distance. It is unusual for any machine, to be both primary and secondary dissipation limited at the same operating point. In the instance of high frequency excitation, primary slot spacing is very close, even for field speeds of 23 meters/second, which necessitates small electrical conductor wire and relatively poor heat transfer out of the primary member of the electromagnetic pump.

SUMMARY OF THE INVENTION

A system for casting metal strips employing an electromagnetic pump in accordance with the present invention comprises: an upper primary block including a plurality of slots adjacent to one side thereof; a lower primary block including a plurality of slots adjacent to one side thereof, with the upper and lower primary blocks being positioned to form a gap therebetween; a movable heat sink disposed within the gap; a nozzle or other means for depositing liquid metal onto the heat sink; and a polyphase winding passing through the slots in the upper and lower primary blocks such that the pole pitch of the winding increases in the direction of travel of the heat sink.

A casting system in accordance with this invention produces metal strips by a method which comprises the steps of: depositing a pool of liquid metal on a movable heat sink; and subjecting the liquid metal and heat sink to a magnetic field which travels in the direction of movement of the heat sink, wherein the wavelength of the magnetic field increases in the direction of movement of the heat sink, thereby subjecting the liquid metal and heat sink to a longitudinal electromagnetic force which travels in the direction of movement of the heat sink, wherein the magnitude of this force progressively increases over the length of the heat sink in the direction of travel due to the increase in field wavelength.

The present invention seeks to provide a thin strip metal casting system which includes an electromagnetic pump that applies controlled longitudinal forces on the belt and liquid metal. In addition, the electromagnetic pump of this invention provides a diminished tendency for primary limited excitation by causing the largest temperature rise, due to high current densities, to occur in the secondary members.

DESCRIPTION OF THE PREFERRED EMBODIMENTS

Figure 1:
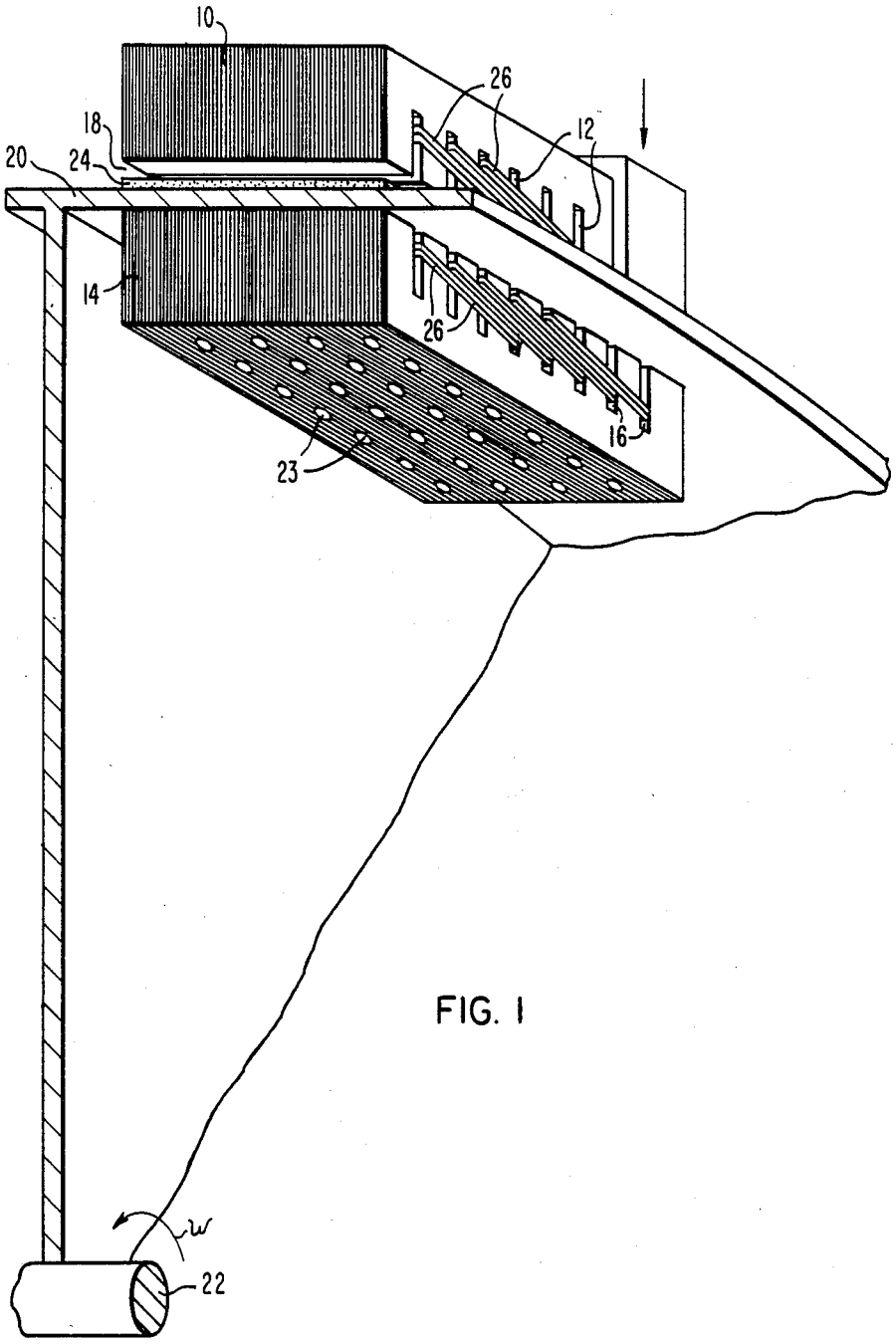
FIG. 1 is a pictorial representation of a portion of a metal strip casting system constructed in accordance with one embodiment of the present invention.

Referring to the drawings, FIG. 1 is a pictorial representation of a portion of a metal strip casting system constructed in accordance with one embodiment of the present invention. An upper primary block 10 having a plurality of slots 12 is positioned above a lower primary block 14 having a plurality of slots 16, thereby forming a gap 18 between the primary blocks. A movable heat sink 20 in the form of a drum mounted for rotation about shaft 22 passes through the gap 18. Coolant passages 23 are shown in lower primary block 14. A nozzle, not shown, is provided for depositing liquid metal onto the heat sink. As the heat sink rotates, this liquid metal solidifies into strip 24. A polyphase winding 26 passes through the slots in the upper and lower primary blocks and produces a longitudinal electromagnetic force which increases in wavelength, and therefore velocity, in the direction of movement of the heat sink 20. In order to achieve this increase in velocity, the winding includes a graded pole pitch.

Figure 2:
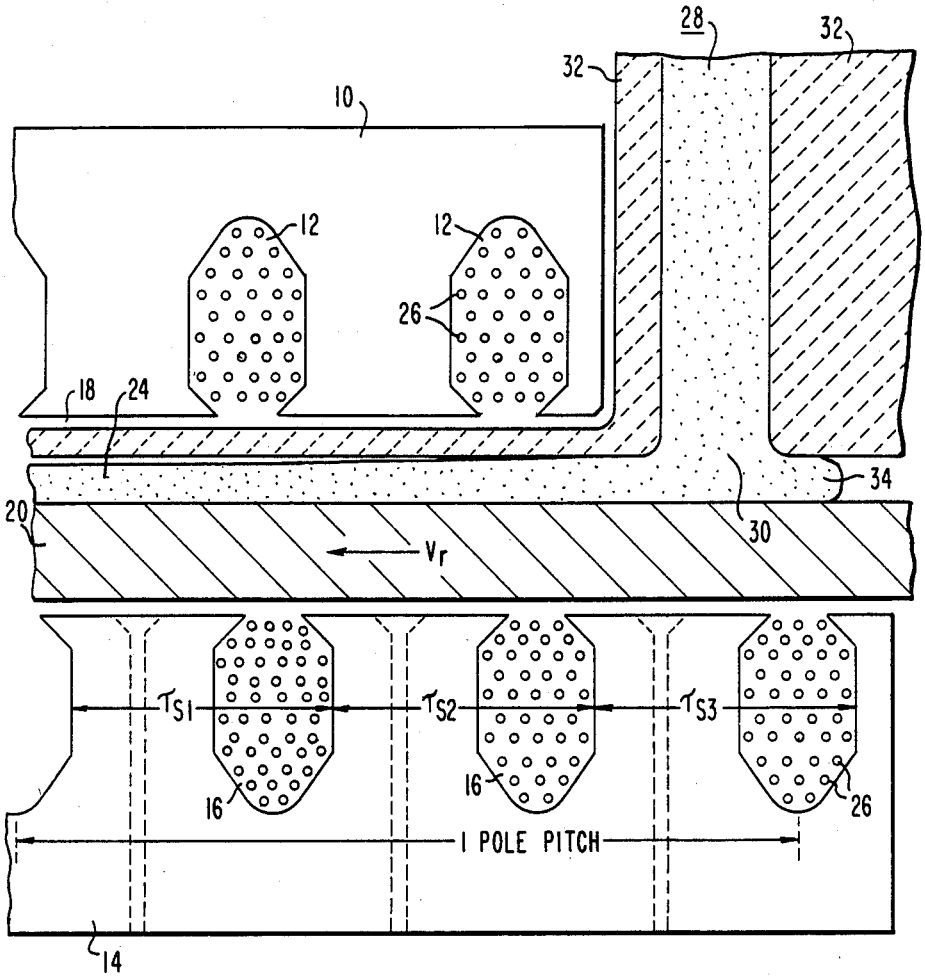
FIG. 2 is a cross section of the nozzle region of a casting system in accordance with this invention.

FIG. 2 is a cross section of the nozzle region of a strip casting system which employs an electromagnetic pump in accordance with the present invention. In this figure, a solidifying steel strip 24 and copper belt heat sink 20 are shown to be sandwiched within gap 18 between upper primary block 10 and lower primary block 14, each carrying polyphase windings 26. As shown in FIG. 1, each primary block is as wide as the intended metal strip width but the length of the primary blocks should be at least as long as the solidification distance and should extend under the steel strip as long as this material remains non-ferromagnetic, that is above 750° C. As seen in FIG. 2, molten metal 28 is injected through nozzle 30 in a ceramic containment structure 32 to form a puddle 34 on belt 20. According to a combination of frequency, resistivity and magnetic permeability, metal strip 24 will either be attracted to or repelled from the closest primary block, with the normal force characteristics changing as a function of slip. When the system is operated as a continuous casting system, it is preferable to have good contact between the steel strip 24 and the copper belt 20 to keep production rates high. This is accomplished by having the windings 26 in the lower primary block 14 produce a large repulsion force on the copper belt 20 and a lower repulsion force, or even a slightly attractive force, on the steel strip specimen 24. This maintains the moving system in compression. My copending application entitled "Double-Sided Electromagnetic Pump With Controllable Normal Force For Rapid Solidification of Metals", Ser. No. 561,426, filed on the same day as this application and assigned to the same assignee, discloses a casting system with controlled normal forces and is hereby incorporated by reference. It is understood that the differences in repulsion force magnitude in this case are entirely due to differences in material surface resistivity, not volume resistivity. Surface electrical resistivity is the quotient of volume resistivity over thickness. In all practical applications, it appears that the belt surface resistivity will be slightly lower than the steel strip surface resistivity due to the combined effects of lower volume resistivity and greater thickness of the former.

As a conservative measure, the specific sheer density for the longitudinal force imparted by each primary block should be about 1270 Newtons/meter squared of active surface area. For example, a primary block 7.62 centimeters wide and 50 centimeters long will be able to impart a force of 48 Newtons or a total of 96 Newtons on the entire length of the copper-beryllium conveyor belt between the primaries. This is a steady state limit on the excitation with forced convection cooling and normal steel magnetic densities. This sheer density can be reduced to a lesser value without creating any apparent problems.

To maintain a synchronous belt speed of 75 feet/-second, the minimum frequency of 300 hertz in the polyphase windings would dictate a pole pitch of 38.1 millimeters (1.5 inches). In practice, to allow a slip of approximately 10%, the pole pitch should be 41.9 mm (1.65 inches) or alternatively the frequency adjusted to at least 330 hertz. This is the conventional method of applying a linear induction pump to a metals extraction or transport process. The present invention differs from this approach in that with single frequency excitation, a progressively increasing field speed is produced through the use of a graded pole pitch winding, thereby providing tensioning forces on the solidifying strip. The mechanical layout of the graded pole pitch primary blocks is more clearly shown with reference to FIG. 3.

Figure 3:
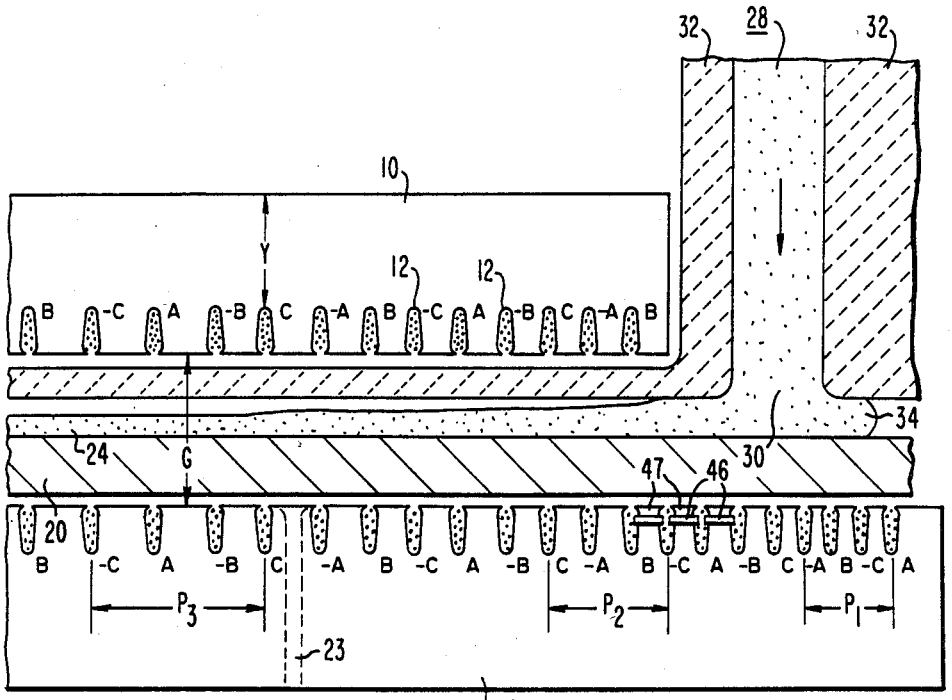
FIG. 3 is a cross section of a portion of a casting system in accordance with this invention.
Figure 4:
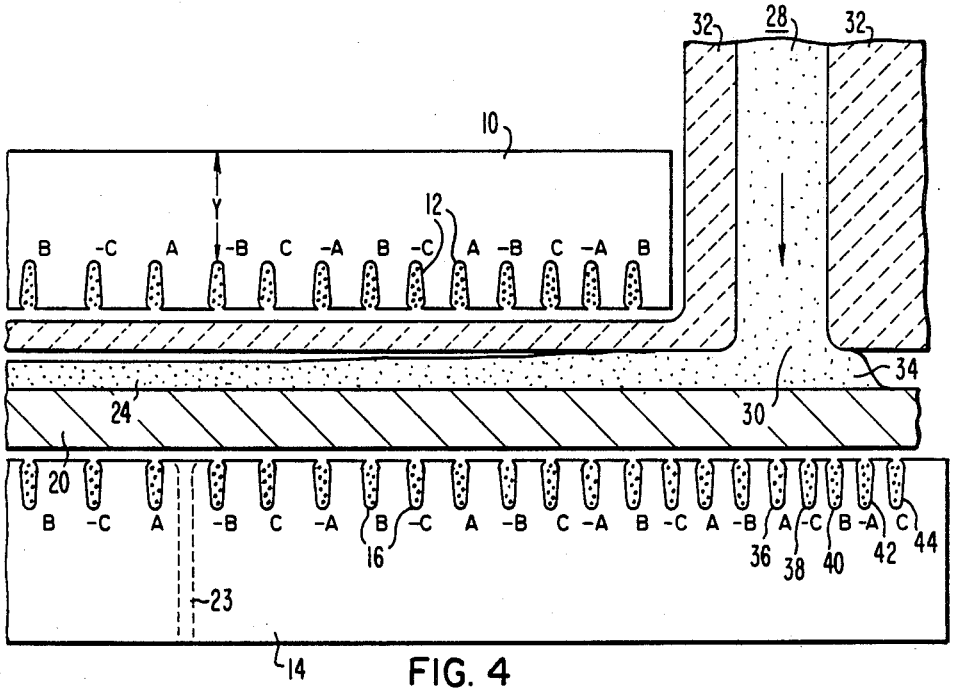
FIG. 4 is a cross section of an alternative embodiment of the present invention casting system.

The grading is directed such that the smaller pole pitch $P_1$ occurs near the nozzle 30 and the length of the pole pitches progresses as illustrated by pole pitches $P_2$ and $P_3$, until the largest pole pitch is achieved at the exit end of the system. All poles of the primary are shown to be wound with a three phase system of polyphase currents such that each pole has one slot/pole/phase. For example, a phasing layout of A, −C, B, −A, C, −B, represents a total of 360° of excitation. Grading of the pole pitch may be accomplished by either: increasing the slot pitch by special lamination punching and retaining the same number of slots/pole/phase; or retaining a uniform slot pitch throughout the entire structure and changing from one slot/pole/phase to two slots/pole/-phase to three slots/pole/phase etc. along the length. The former approach is illustrated in FIGS. 2, 3 and 4. For example, referring to FIG. 2, the slot spacing $\tau_s$ increases such that $\tau_{s1} \geqq \tau_{s2} \geqq \tau_{s3}$. The graded pole pitch winding results in a graded field speed which reduces the tendency for buckling of the newly formed steel strip since the pump is an electromagnetic tensioning device. Due to the fact that secondary resistivities, that is the resistivities of the steel strip 24 and belt 20, are both very high, the electrical time constant (inductance/resistance) of the secondary circuit comprising current loops in the strip and belt, is negligible. This means that the current pattern established at each pole in the secondary decays so rapidly that there are only marginal interference effects in changing pole pitch continuously and reestablishing a new and slightly longer field pattern over each pole.

One advantage of the graded pitch winding is that the change in pitch can be coordinated with the change in the effective surface resistivity of the combined belt and steel strip. It is important to note that while the steel strip drops in resistivity as a function of belt position away from the nozzle 30, the belt increases in resistivity by a far greater degree as a function of distance. Over a broad range of operating conditions, it is convenient to assume constant resistivity for all of the solidified steel strip and model the combined steel and copper structure as having a single resistive dependence.

For example, if the resistance change of the copper-beryllium belt is taken as the norm, a temperature excursion from 350° K. to the range of 900° to 1100° K. results in a surface resistivity change from 4.78 micro-ohms to about 13.25 micro-ohms. When this resistivity is combined with the parallel resistivity of the steel strip of 944 micro-ohms, based on a 50 mil thickness, the total surface resistivity changes from 4.75 micro-ohms to 13 micro-ohms. Since this represents a 2.7521 change factor, the appropriate increase in velocity of the electromagnetic field may be obtained by: increasing the pole pitch by a ratio based on the square root of the resistivity change, such as from 4.19 to 6.96 cm (1.65 inches to 2.74 inches) gradually on a pole by pole basis; or supplying each pole winding with a progressively higher frequency, originating at 330 hertz and increasing, for example in 5 to 10 steps, up to 908 hertz. The former is the most viable option due to the simplicity of operation, although construction is marginally more expensive than the second option for just the pump alone. For the entire system of pump plus variable frequency inverter, the first option will continue to be the most economical. With this system, it is possible to maintain, along the length of the conveyor, a constant magnetic Reynolds number, R, which is defined as:

$$R = 2\tau_p^2 f \mu_o / \pi \rho_s g \tag{9}$$

where $\rho_s$ is the composite surface resistivity of the secondaries, $\mu_o$ the permeability of free space, and g is the "entrefer" or ferromagnetic air gap appropriate to each primary, for example $g = G/2$, where G is the length of the gap between primary blocks 10 and 14. The R factor also is equal to the ratio of current which is induced in the composite secondary versus the magnetizing current needed to establish the radially directed magnetic field in the gap.

Each primary block 10 and 14 is constructed of ferromagnetic steel laminations arranged to form a flat surface block, or partial arc, according to the belt or spin wheel geometry of the heat sink 22. Slots are punched in the primary blocks along the surface adjacent to the gap between the blocks and transverse to the belt movement for electrical conductors as in conventional rotating machinery. The slots should not be totally closed or semiclosed in these punchings due to the necessarily long magnetic air gap and the desire to keep leakage magnetic flux to a minimum. An example system may include blocks which are 7.62 centimeters to 20.3 centimeters wide and 20 to 60 centimeters long. The core depth, Y, is dependent on the pole pitch and as a general rule should be at least 40% of the pole pitch. For the example system, this may extend from 1.68 centimeters to 2.8 centimeters. The overall block depth which is the sum of the core depth plus the slot depth ranges from 2.5 to 3.5 centimeters in the example.

The starting location of the primary blocks is extremely important, and as can be seen from FIG. 3, it is not possible to have both blocks start at the mouth of the steel puddle 34, since the main nozzle assembly and reservoir take away room from the upper primary block. However, it is important to start the lower primary block well ahead of the full puddle area, that is near the nozzle back wall. Due to the flexible design nature of electromagnetic pumps, it is also possible to reverse the field orientation just under the nozzle back wall to put a small section of the melt in the puddle region into longitudinal tension rather than compression. This is illustrated in FIG. 4 wherein the windings have been reversed in slots 36 through 44. Providing tensioning forces to the leading edge of the puddle will reduce the probability of air bubbles being included between the metal strip and the heat sink.

As an alternative to this abrupt change in phase by 180° for localized field reversals, one means of obtaining small flux phase delays is to include shading rings around selected teeth of the lower primary block under the vicinity of the melt feed nozzle. Such rings 46 are illustrated in FIG. 3. These rings shift the radial flux in phase by increments of less than 30° or 15° as normally obtainable in multiple slot/pole/phase systems. This improvement is valuable where phase changes and resistivity changes from liquid to solid are occurring. By way of example, these shading rings may comprise a copper strap forming a closed electrical loop around each primary tooth, 47, with this conductor occupying a significant portion of each conventional primary slot, which also carries the polyphase excitation windings. It is not necessary to connect these shading rings to a common bus bar.

The total number of poles along each primary block should not necessarily be an integral even number as is common in conventional rotating machinery, but is dependent on the per unit slip, s, at any frequency to determine the optimum, non-integral pole pitches of excitation. As is true for all singly and doubly excited discontinuous stator machines, to optimize for efficiency, the number of poles, n, should satisfy the requirement that $n=(1-s)/s$, assuming that the magnetomotive force is current forced such as by connecting all of the machine coils for a given phase in series. For example, with reference to FIG. 3, if the shading coils are neglected, a total of $3\frac{1}{2}$ poles are shown for the lower primary member, in which case maximum efficiency occurs at about 22% slip. In the case where shading coils have been added or a section contains reversed phasing, then only the latter section should not be included for the pole count, whereas the effect of shading is merely to shift phase rather than cancel flux.

In practice, the use of a graded pitch electromagnetic pump allows the added flexibility of increasing the number of ampere turns per slot through making the slots wider, but not deeper, than shown in FIGS. 2, 3 and 4 as the pole pitch increases. The variable magnetomotive force feature of the described invention is useful in continuous casting technology since it helps to compensate for the change in resistivity as a function of length.

Although the present invention has been described in terms of what are at present believed to be the preferred embodiments, it will be apparent to those skilled in the art that various changes may be made without departing from the scope of the invention. Therefore the appended claims are intended to cover all such changes.

I claim:

1. A system for casting of molten metals having an electromagnetic pump comprising:

an upper primary block including a plurality of slots adjacent to one side thereof;

a lower primary block including a plurality of slots adjacent to one side thereof, said upper and lower primary blocks being positioned to form a gap therebetween:

a movable heat sink disposed within said gap;

means for depositing liquid metal onto said heat sink; and a polyphase winding passing through said slots in said upper and lower primary blocks such that the pole pitch of said winding increases in the direction of travel of said heat sink.

2. A casting system as recited in claim 1, wherein the number of turns per slot in said polyphase winding increases as the pole pitch increases.

3. A casting system as recited in claim 1, wherein the distance between successive slots in said upper and lower primary blocks increases in the direction of travel of said heat sink.

4. A casting system as recited in claim 1, wherein the slots in said upper and lower primary blocks are uniformly spaced and the number of slots per pole per phase of said polyphase winding increases in the direction of travel of said heat sink.

5. A casting system as recited in claim 1, wherein the change in pole pitch is proportional to the change in effective surface resistivity of the heat sink and an adjacent strip of said metal.

6. A casting system as recited in claim 1, wherein the length of said upper and lower primary blocks is greater than or equal to the solidification distance of said metal.

7. A casting system as recited in claim 1, wherein the slots in said primary blocks run perpendicular to the direction of motion of said heat sink.

8. A casting system is recited in claim 1, wherein the width of said primary blocks is equal to the width of a strip of said metal formed adjacent to said heat sink.

9. A casting system as recited in claim 1, wherein said means for depositing liquid metal is positioned at one end of said upper primary block and said lower primary block extends below and ahead of said means for depositing liquid metal.

10. A casting system as recited in claim 9, wherein a portion of said winding in said lower primary block which lies in slots ahead of said means for depositing liquid metal is wound to produce a magnetic field which is oriented opposite to the magnetic field produced by said winding in the other slots of said lower primary block.

11. A casting system as recited in claim 1, further comprising:

a shading coil in selected slots of said lower primary block.

12. A casting system as recited in claim 1, wherein said heat sink has a lower resistivity than said metal.

13. A casting system as recited in claim 1, wherein said polyphase winding comprises:

a first component wound in the slots of said upper primary block and a second component wound in the slots of said lower primary block, wherein said first and second components are electrically connected in series.

14. A casting system as recited in claim 1, wherein said heat sink comprises:

a cylinder mounted for rotation around a point located below said lower primary block.

15. A casting system as recited in claim 1, wherein said heat sink comprises:

a movable belt.

16. A casting system as recited in claim 1, wherein said heat sink is copper.

17. A method of casting metal strips comprising the steps of:

depositing a pool of liquid metal on a movable heat sink; and subjecting said liquid metal and heat sink to a magnetic field which travels in the direction of movement of the heat sink, wherein the wavelength of the magnetic field increases in the direction of movement of the heat sink thereby subjecting said liquid metal and heat sink to a longitudinal electromagnetic force in the direction of movement of the heat sink, wherein the magnitude of the electromagnetic force progressively increases over the length of the heat sink, in the direction of travel due to said increase in field wavelength.

18. A method as recited in claim 17, wherein the resistivity of said heat sink is less than the resistivity of said metal.

* * * * *